United States Patent [19]

Alde, Sr.

[11] 4,066,003

[45] Jan. 3, 1978

[54] HYDRAULIC ENGINE

[76] Inventor: Murray William Alde, Sr., Box 38, Saltery Bay, R.R. No. 3, Powell River, B.C. , Canada, V8A 5C1

[21] Appl. No.: 754,489

[22] Filed: Dec. 27, 1976

[51] Int. Cl.[2] ..... F01B 1/00

[52] U.S. Cl. ..... 91/170 R; 91/411 R; 60/374; 60/484

[58] Field of Search ..... 91/170 R, 172, 194, 91/303, 339, 411 R; 60/374, 483, 484

[56] References Cited

U.S. PATENT DOCUMENTS

| | | | |
|---|---|---|---|
| 1,047,328 | 12/1912 | Sundh | 60/483 X |
| 3,630,120 | 12/1971 | Carlson et al. | 91/411 R |
| 3,765,180 | 10/1973 | Brown | 60/374 X |

*Primary Examiner*—Edgar W. Geoghegan

[57] ABSTRACT

A hydraulic engine having a frame on which a crankshaft is rotatably mounted between a plurality of cylinders. The individual cylinders are rockingly mounted on the frame arranged as opposed pairs of cylinders and their piston rods are operatively connected to cranks positioned 90° apart upon the crankshaft. A power takeoff shaft is also journalled on the frame and a drive train operatively connects the crankshaft to the power takeoff shaft. The cylinders are connected by a fluid circuit to a motor-driven pump and included in the circuit are individual distribution valves for the cylinders. Operating plungers of the valves are connected by rods to eccentrics carried by the crankshaft and circumferentially positioned to extend and retract the several piston rods in a sequence which will rotate the crankshaft and deliver usable power to the takeoff shaft.

4 Claims, 5 Drawing Figures

HYDRAULIC ENGINE

This invention relates to an improved hydraulic engine.

The present engine is particularly intended for use as a source of power to drive an electric generator but it has a number of other useful applications as well, for example, the engine will power urban transit vehicles, locomotives, ships and so on. As a source of power for such purposes, the engine is relatively quite, non-polluting and efficient which cannot be said for conventional internal combustion engines.

More specifically, according to the present invention there is provided a hydraulic engine which comprises a frame, a crankshaft journalled on the frame, hydraulic cylinders arranged on the frame as horizontally opposed and side-by-side pairs, a piston rod for each cylinder operatively connected to the crankshaft, trunnion means individually securing each cylinder to the frame whereby adjacent cylinders of each pair of cylinders are rockable about a common axis extending parallel to the crankshaft, a power take-off shaft journalled on the frame, a drive train operatively connecting the crankshaft to the power take-off shaft, a fluid circuit connecting the hydraulic cylinders to a source of pressurized fluid and including a distribution valve for each of said cylinders, and motion transmitting means connecting the crankshaft to the distribution valves whereby opposite ends of the hydraulic cylinders are pressurized sequentially to extend and retract the piston rods and rotate said crankshaft.

Figure 1:
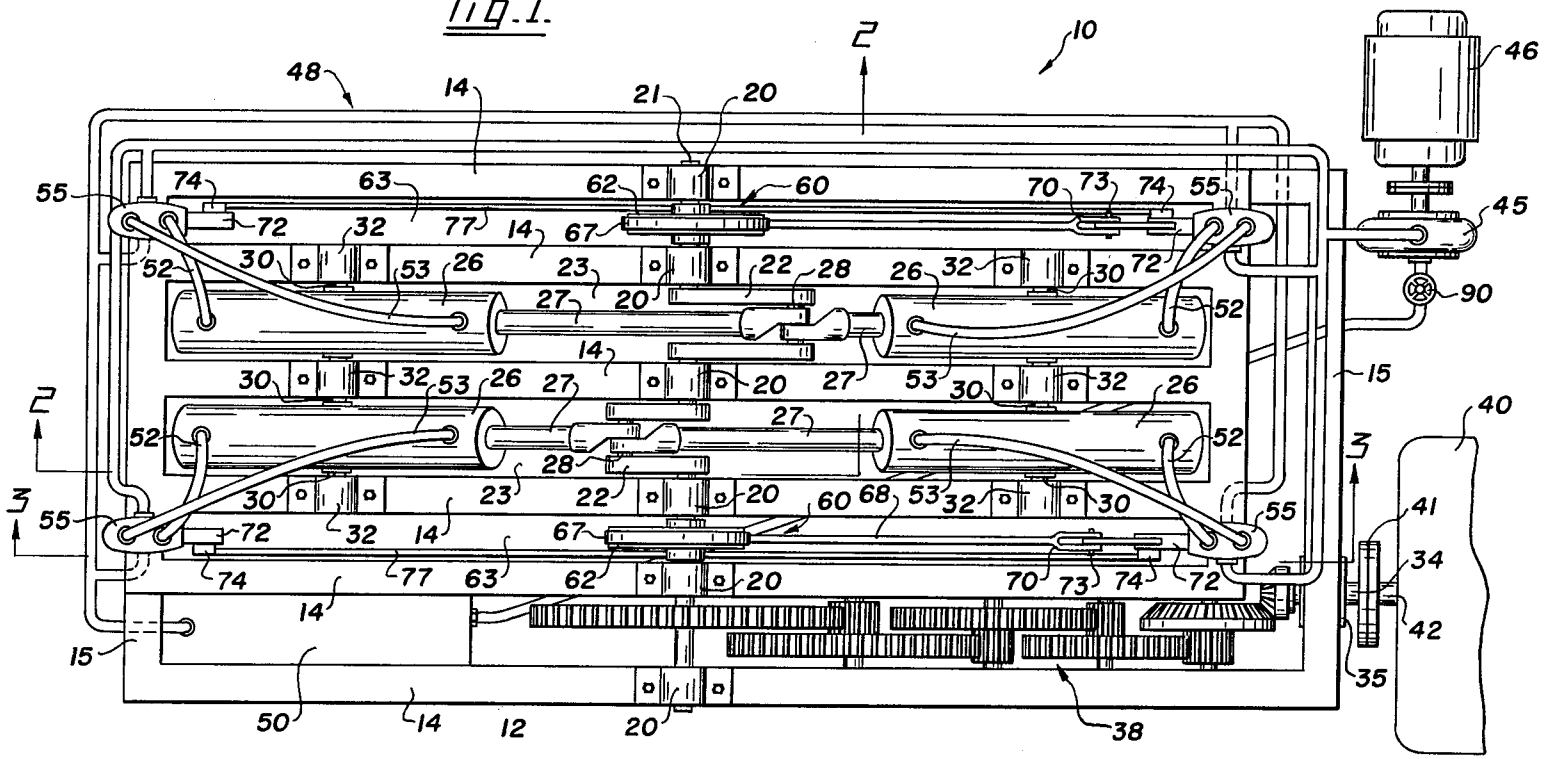
Figures 2, 3, 4, 5:
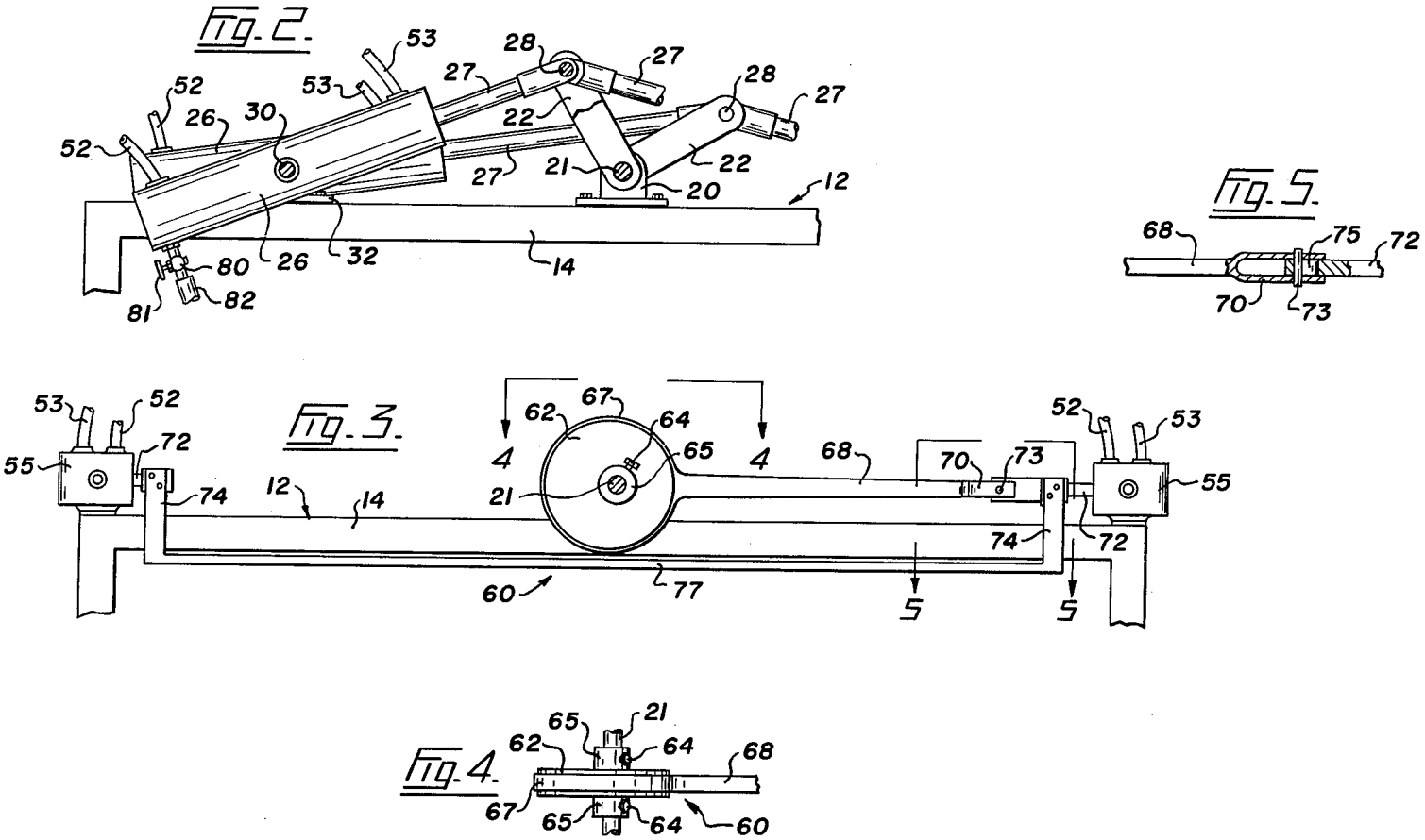

In drawings which illustrate a preferred embodiment of the invention;

FIG. 1 is a plan view of a hydraulic engine embodying the present invention,

FIG. 2 is an enlarged section taken on the line 2—2 of FIG. 1 with parts broken away to show in detail a hyrdraulic cylinder of the engine, FIG. 3 is a longitudinal section taken on the line 3—3 of FIG. 1, FIG. 4 is a detailed section taken on the line 4—4 of FIG. 3, and FIG. 5 is detailed section taken on the line 5—5 of FIG. 3.

Referring to the drawings, the numeral 10 indicates generally a hydraulic engine in accordance with the present invention. Engine 10 is mounted on a rectangular and table-like frame 12 which, in FIG. 1, will be seen to have six transversely spaced and longitudinally extending members 14 as well as end members 15.

Mounted on the members 14 about midway between the members 15, are bearings 20 which journal a crankshaft 21. This crankshaft has two cranks 22 which are adapted to rotate within spaces 23 provided between three of the frame members 14. In FIG. 2, the cranks 22 are shown spaced 90° apart on the crankshaft. The spaces 23 also accommodate four hydraulic cylinders 26 having piston rods 27, the cylinders being arranged side-by-side to operate as horizontally opposed pairs. The outer end of each rod 27 is connected by a pin 28 to one of the cranks 22. The cylinders 26 are quite large, for example, they may have a twelve inch bore with the rod 27 having a four feet stroke. Each cylinder 26 is provided with trunnions 30 which project from the sides of the cylinders about midway between opposite ends thereof. The trunnions 30 are journalled in bearings 32 mounted on frame members 14. Each pair of cylinders is mounted on the frame to rock in a common vertical plane and independently of the other pair of cylinders. The cylinders 26 at each end of the frame 12 rock about a common transverse axis of their trunnions 30.

Thus, when opposite ends of the cylinders 26 are pressurized at appropriately timed intervals, the crankshaft 21 is rotated to provide usable power which is taken off through a shaft 34, see FIG. 1 only. This take-off shaft 34 is journalled in a suitable bearing 35 mounted on the frame 12 below one end member 15, the shaft being disposed at right angles to the crankshaft 21. A gear-type drive train generally indicated at 38 transmits rotational motion of the crankshaft 21 to the take-off shaft 34 to rotate the latter shaft at greatly increased speed.

The present engine can be used to drive an electric generator 40, for example, in which case the shaft 34 is connected by a coupling 41 to an input shaft 42 of the generator.

The engine 10 is powered by fluid pressure developed by an oil pump 45, see FIG. 1, the pump in turn being driven by an electric motor 46. The pump 45 is included in a hydraulic circuit generally indicated at 48. This hydraulic circuit includes a reservoir 50 carried by one corner of the frame 12 and the numerous lines needed to operatively connect the reservoir to the pump and the four cylinders. For example, the opposite ends of each cylinder 26 is connected by flexible hoses 52 and 53 to a distribution valve 55 mounted on an end member 15 near the closed end of that cylinder.

In order to open and close the four valves 55 in proper sequence, the engine 10 is provided with drive transmitting means generally indicated at 60 see FIGS. 1, 3 and 4. There is one such means 60 for each pair of opposed cylinders 26 and, as shown best in FIGS. 3 and 4, the means comprises an eccentric 62 which is mounted on the crankshaft 21 in a space 63 between two of the longitudinal members 14. This eccentric 62 is mounted on a sleeve 65 through which the crankshaft rotatably extends. One, or preferably two, clamping screws 64 are fitted to the sleeve 65 so that the eccentric can be adjusted circumferentially of the crankshaft. The eccentric 62 rotates within a bearing 67 provided on one end of a horizontally projecting rod 68. The opposite end of rod 68 has a fork 70 in which an operating plunger 72 for a valve 55 is slidably mounted. Fork 70 is connected by a pivot pin 73 to an arm 74 secured to the plunger 72. The pin 73 slidably projects through a slot 75 in the arm 74 to provide a desirable amount of lost motion between rotation of the crankshaft and the opening and closing movements of the valves 55 controlling the pairs of cylinders. A U-shaped bar 77 connects the arm 74 secured to one valve to the corresponding plunger 72 of the distribution valve for the opposing cylinder.

The hydraulic circuit 48 includes a relief valve 80 which is fitted to the closed end of each cylinder 26, see FIG. 2. This valve 80 is adjusted to open at a selected pressure by means of a hand wheel 81 and a return line 82 extends from the valve to the reservoir 50. The purpose of installing a valve 80 for each cylinder 26 in this particular position will be understood when the operation of the engine is considered.

In operation, the motor 46 is started to develop the fluid pressure required to operate the engine 10. The relief valves 80 are opened to discharge any oil which may have been left in the closed ends of the cylinders at the completion of the previous run, whereupon those valves are adjusted to open thereafter only at a predetermined high pressure. A master control valve 90 (FIG. 1 only) of the engine is opened a suitable distance to allow pressurized fluid to flow to the valves 55 for distribution thereby to appropriate ends of the four cylinders. The extremely high driving force developed by the cylinders 26 is transmitted to the crankshaft 21 and through the drive train 38 to the take-off shaft 34 so that the generator 40 is driven at operating speed.

From the foregoing, it will apparent that this hydraulic engine will operate by the pressure developed by a small, conventional and motor-driven pump to generate the force needed to drive a generator or the like at high speed. The efficiency of the engine is high and the absence of exhaust fumes and objectional noise are features which recommend use of the engine over gasoline or diesel-burning engines.

I claim:

1. A hydraulic engine comprising a frame, a crankshaft journalled on the frame, hydraulic cylinders arranged on the frame as horizontally opposed and side-by-side pairs, a piston rod for each cylinder operatively connected to the crankshaft, trunnion means individually securing each cylinder to the frame whereby adjacent cylinders of each pair of cylinders are rockable about a common axis extending parallel to the crankshaft, a power take-off shaft journalled on the frame, a drive train operatively connecting the crankshaft to the power take-off shaft, a fluid circuit connecting the hydraulic cylinders to a source of pressurized fluid and including a distribution valve for each of said cylinders, and motion transmitting means connecting the crankshaft to the distribution valves whereby opposite ends of the hydraulic cylinders are pressurized sequentially to extend and retract the piston rods and rotate said crankshaft.

2. A hydraulic engine as claimed in claim 1, in which said distribution valves of each horizontally opposed pair of cylinders have operating plungers, a connector bar interconnecting the operating plungers of each pair of opposed cylinders, said motion transmitting means comprising an eccentric mounted on the crankshaft alongside each pair of opposed cylinders, a rod rotatably mounted at one end thereof on each eccentric and being connected at the opposite end thereof to an operating plunger of an adjacent valve.

3. A hydraulic engine as claimed in claim 2, in which each eccentric is carried by a sleeve rotatably mounted on the crankshaft, and clamping means for securing each sleeve in a selected circumferential position on the crankshaft.

4. A hydraulic engine as claimed in claim 3, in which said hydraulic circuit includes a return line connecting the closed end of each cylinder to the reservoir, and a hand-operated relief valve in the return line.

* * * * *

UNITED STATES PATENT AND TRADEMARK OFFICE

CERTIFICATE OF CORRECTION

PATENT NO. : 4,066,003

DATED : January 3, 1978

INVENTOR(S) : Murray W. Alde, Sr.

It is certified that error appears in the above–identified patent and that said Letters Patent are hereby corrected as shown below:

In the left hand column of the facesheet, between blocks (22) and (51) insert:

--Foreign application priority data

January 16, 1976 Great Britain ... No. 01678/1976--

Signed and Sealed this

*Tenth* Day of *April 1979*

[SEAL]

*Attest:*

RUTH C. MASON
*Attesting Officer*

DONALD W. BANNER
*Commissioner of Patents and Trademarks*